United States Patent [19]

Huon de Kermadec

[11] 4,413,568

[45] Nov. 8, 1983

[54] METHOD OF AUTOMATICALLY OPERATING A SEMI-CONTINUOUS PASSENGER TRANSPORT SYSTEM USING PASSIVE VEHICLES, AND MEANS FOR IMPLEMENTING SAME

[75] Inventor: Jean Huon de Kermadec, Versailles, France

[73] Assignee: Soule Fer et Froid S.A., Bagneres de Bigorre, France

[21] Appl. No.: 224,560

[22] PCT Filed: Apr. 3, 1980

[86] PCT No.: PCT/FR80/00052

§ 371 Date: Nov. 26, 1980

§ 102(e) Date: Nov. 26, 1980

[87] PCT Pub. No.: WO80/02128

PCT Pub. Date: Oct. 16, 1980

[30] Foreign Application Priority Data

Apr. 4, 1979 [FR] France ..... 79 08510

[51] Int. Cl.[3] ..... B61B 13/12

[52] U.S. Cl. ..... 104/20; 49/28; 105/395; 246/187 B; 246/187 C

[58] Field of Search ..... 104/20, 18, 19, 25, 104/165, 168, 205, 209, 214, 217; 105/341, 348, 349, 395; 49/26, 27, 28; 246/126, 127, 187 B, 187 C

[56] References Cited

U.S. PATENT DOCUMENTS

| | | | |
|---|---|---|---|
| 1,793,498 | 2/1931 | L'Heritier | 198/334 |
| 2,756,686 | 7/1956 | Kendall et al. | 104/25 |
| 2,905,100 | 9/1959 | Kendall et al. | 104/25 |
| 3,236,191 | 2/1966 | Bouladon et al. | 104/25 |
| 3,400,665 | 9/1968 | Bouladon et al. | 104/25 |
| 3,759,566 | 9/1973 | Sobey et al. | 105/341 X |
| 3,857,197 | 12/1974 | Reddy et al. | 105/341 X |
| 3,871,303 | 3/1975 | Woodling | 104/173 R |
| 4,093,161 | 6/1978 | Auer, Jr. | 246/187 B X |

FOREIGN PATENT DOCUMENTS

| | | | |
|---|---|---|---|
| 15581 | 9/1980 | European Pat. Off. | 104/18 |
| 1500098 | 11/1967 | France . | |
| 1509115 | 12/1967 | France . | |
| 1552832 | 1/1969 | France . | |
| 2133102 | 11/1972 | France . | |
| 2133891 | 6/1973 | France . | |
| 2207050 | 6/1974 | France . | |
| 2117759 | 11/1974 | France . | |
| 2281861 | 3/1976 | France . | |
| 2300698 | 9/1976 | France . | |
| 2301423 | 9/1976 | France . | |
| 2300698 | 6/1978 | France . | |
| WO80/02128 | 10/1980 | PCT Int'l Appl. | 104/18 |
| 55142 | 5/1968 | Poland | 105/341 |

OTHER PUBLICATIONS

Le VEC Transport En Commun Dans La Ville–SA-VEC, 11, Avenue de la gare Coignieres, 78310 Maurepas.

Exemples de VEC envisages pour un service de navette.

Exemples de VEC envisages pour le dessert d'une zone dense.

*Primary Examiner*—Richard A. Bertsch
*Assistant Examiner*—Mitchell J. Hill
*Attorney, Agent, or Firm*—Spencer & Kaye

[57] ABSTRACT

A method and apparatus for automatically operating a semi-continuous passenger transport system using non-motorized vehicles. Fault conditions corresponding to passengers or articles carried by passengers projecting beyond a surface limiting access to the vehicles in stations are detected. Detection of such fault conditions initiates progressive implementation of fault condition signalling, and slowing and stopping of the tracks which drive the vehicles. These measures are progressively cancelled on clearance of the fault condition.

22 Claims, 19 Drawing Figures

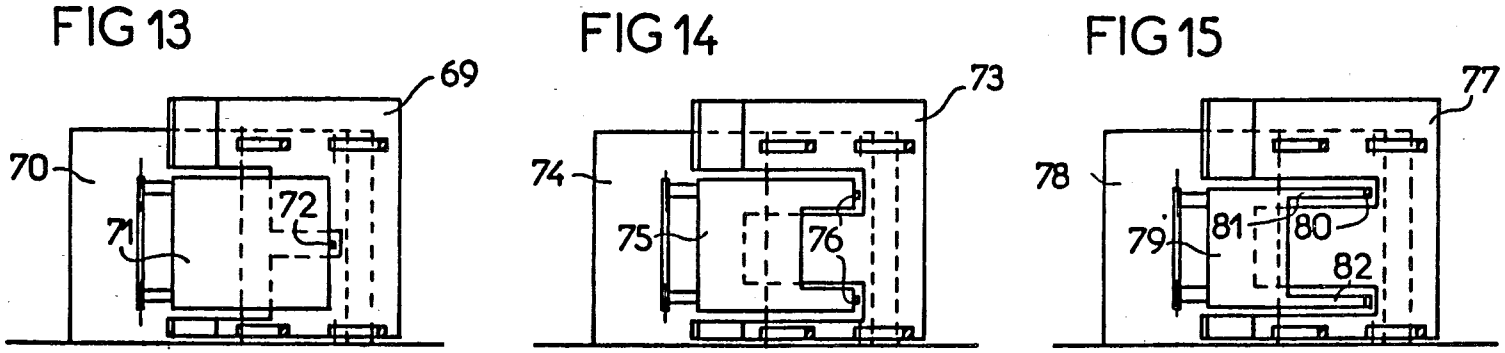
FIG 13
FIG 14
FIG 15
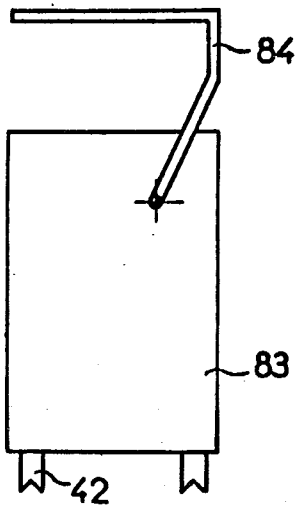
FIG 17
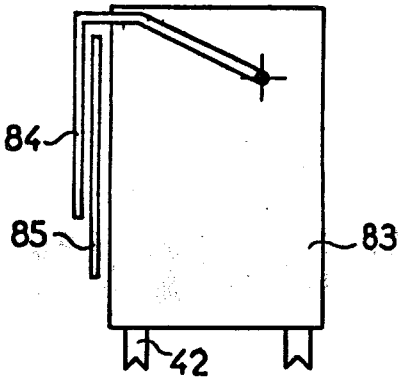
FIG 16

METHOD OF AUTOMATICALLY OPERATING A SEMI-CONTINUOUS PASSENGER TRANSPORT SYSTEM USING PASSIVE VEHICLES, AND MEANS FOR IMPLEMENTING SAME

BACKGROUND OF THE INVENTION

The present invention concerns semi-continuous passenger transport systems using passive vehicles, in which non-motorized vehicles are driven by means of successive driving tracks along a closed circuit serving at least two stations, at a cruising speed between stations and at a slow speed past embarkation and disembarkation platforms within stations, appropriate transition areas being provided at each end of the aforementioned platforms.

In resorts in mountainous areas, certain cable car transport systems are semi-continuous according to the definition set out in the preceding paragraph. The presence of supervisory personnel and the slow speed of vehicles during embarkation and disembarkation of passengers reduces the risk of accidents occurring during these operations.

A number of semi-continuous transport systems for urban use are currently being developed in France. Issue No 53 (September 1978) of the Journal "Sciences et Techniques" discusses these in an article entitled "Le point sur les modes de transport nouveaux en France" ("New transport systems in France—a survey"). The systems discussed comprise:

"VEC", Company "SAVEC", covered by Patent No 70.45238, for example;

"POMA 2000", Company "POMA 2000", Patent No 71.12413;

"DTILTA V", Company "HEF", Patent No 75.05206.

These systems have more ambitious objectives than cable cars: increased traffic handling and limitation of supervisory personnel through more extensive automatic control. System reliability and passenger safety thus raise new problems.

The maximum capacity of a semi-continuous transport system is achieved when in the minimum speed sections (embarkation and disembarkation) the vehicles are in contact with one another, most often following on from one another at intervals of a few seconds. Unless special arrangements are made, stopping one vehicle stops the entire system.

Embarkation into a moving vehicle means that passengers have a specific time within which to embark. Any distraction, the wish to avoid being separated from other passengers and being inconvenienced by packages carried are all factors which can result in passengers finding themselves in a dangerous position, especially at the end of the platform.

It would seem that the only automatic system guarding against this hazard currently known is that of the VEC system, comprising a pivoted barrier at the end of the embarkation platforms. If a passenger attempting to embark too late comes into contact with this barrier, the complete system is shut down, considerably reducing its efficiency.

If the vehicles are fitted with doors, which enhances passenger safety, then impediments to the closing of the doors will constitute a major new source of fault conditions caused by passengers. This hazard is already well-known in connection with elevators and is likely to be all the more serious in the case of semi-continuous transport systems which require passengers to embark on vehicles in motion within a limited time interval. Elevator manufacturers have developed many systems for detecting these fault conditions and delaying departure of the elevator until the fault condition is cleared. This operating method is not validly transposable to semi-continuous transport systems in the current state of the art, as stopping one vehicle results in the complete shutdown of the system with all the attendant repercussions with regard to the complexity of operation and efficiency of the system.

SUMMARY OF THE INVENTION

The operating method in accordance with the present invention is intended to provide a high level of passenger safety in semi-continuous systems, automatically (that is to say, without the intervention of supervisory personnel) and without seriously compromising efficiency, in two ways: (1) By reducing the consequences of most fault conditions caused by passengers during embarkation and disembarkation. Many such fault conditions occur, and most can be cleared by allowing the passenger a short time to correct his action, by stopping the vehicle. To this end, the invention confers on semi-continuous systems a degree of "elasticity", defined as the facility for stopping a vehicle in a station by retarding the stopping of vehicles currently in transit between stations. The elasticity is total if a fault condition due to a passenger (whatever its duration and location) interrupts the embarkation of new passengers until the fault condition is cleared, without disrupting the service for passengers already embarked. (2) By reducing the risk of occurrence and the duration of fault conditions due to passengers embarking and disembarking, through the use of appropriate means of detecting such fault conditions.

To this end, the method in accordance with the invention detects fault conditions due to passengers or articles carried by passengers projecting beyond a surface which limits access to the vehicles within the stations, progressively implements at least some of the following measures in the event that a fault condition is detected:

signalling the fault condition, stopping the track driving the vehicle affected, stopping other tracks in the station, slowing and stopping transition tracks on the upstream side, rerouting and parking vehicles, stopping cruising speed tracks, and progressively cancels the measures implemented following clearance of the fault condition.

In the method thus defined, elasticity is achieved through the automatic control of the tracks according to information provided by means for detecting passenger-generated fault conditions and the positions of the vehicles. The occurrence of a fault condition results in the progressive accumulation of vehicles on the upstream side, through the slowing and stopping of tracks and possibly the rerouting and parking of vehicles on an alternative route. Clearance of the fault condition, if it does not last more than a certain time which depends on the installation, progressively releases the vehicles until they are normally distributed over the entire route. The slowing of the tracks affects only a small number of special tracks known as "variable speed tracks", which can operate at two different speeds. Moreover, certain tracks are controlled so as to eliminate the risk of collision introduced by the operating method in accordance with the invention.

According to an advantageous embodiment of the invention, at the end of the platform the vehicles move past a control wall adapted to detect any object projecting beyond the opening in a vehicle. Any such object displaces the control wall, without impeding the movement of the passenger, so that the passenger can get out of the dangerous position in which he finds himself. To reduce the frequency with which the system is stopped, the control wall may with advantage comprise two panels: one panel which stops the vehicle when moved and, on its upstream side, a signaling panel which when moved trips a system for signaling the dangerous position of the passenger concerned.

If the vehicles are fitted with doors, these are closed as the vehicle openings move past the control wall. The latter may with advantage be arranged so that the door moves behind it as it closes.

Further features of the invention will emerge from the following detailed description.

BRIEF DESCRIPTION OF THE DRAWINGS

In the accompanying drawings, which show various embodiments of the invention by way of non-limiting example only:

FIGS. 13, 14 and 15 are analogous to the central portion of FIG. 10, showing different forms of control wall and door;

FIG. 16 is a schematic elevation perpendicular to the direction of movement of the vehicles, showing a vehicle fitted with a "visor" type door in the open position;

FIG. 17 is analogous to FIG. 16, showing the door in the closed position.

DESCRIPTION OF THE PREFERRED EMBODIMENTS

In the following description and claims, the term "upstream" should be understood as the location from which the vehicle comes relative to a given point and the term "downstream" as the location to which it is going relative to this point; that is, the direction of movement of the vehicle is from upstream to downstream. The qualification "active" as designating the moving state of drive systems, the operative state of "signaling means", and the presence of a vehicle or passenger in the case of the "vehicle position monitoring means" and "passenger position monitoring means".

Figure 1:
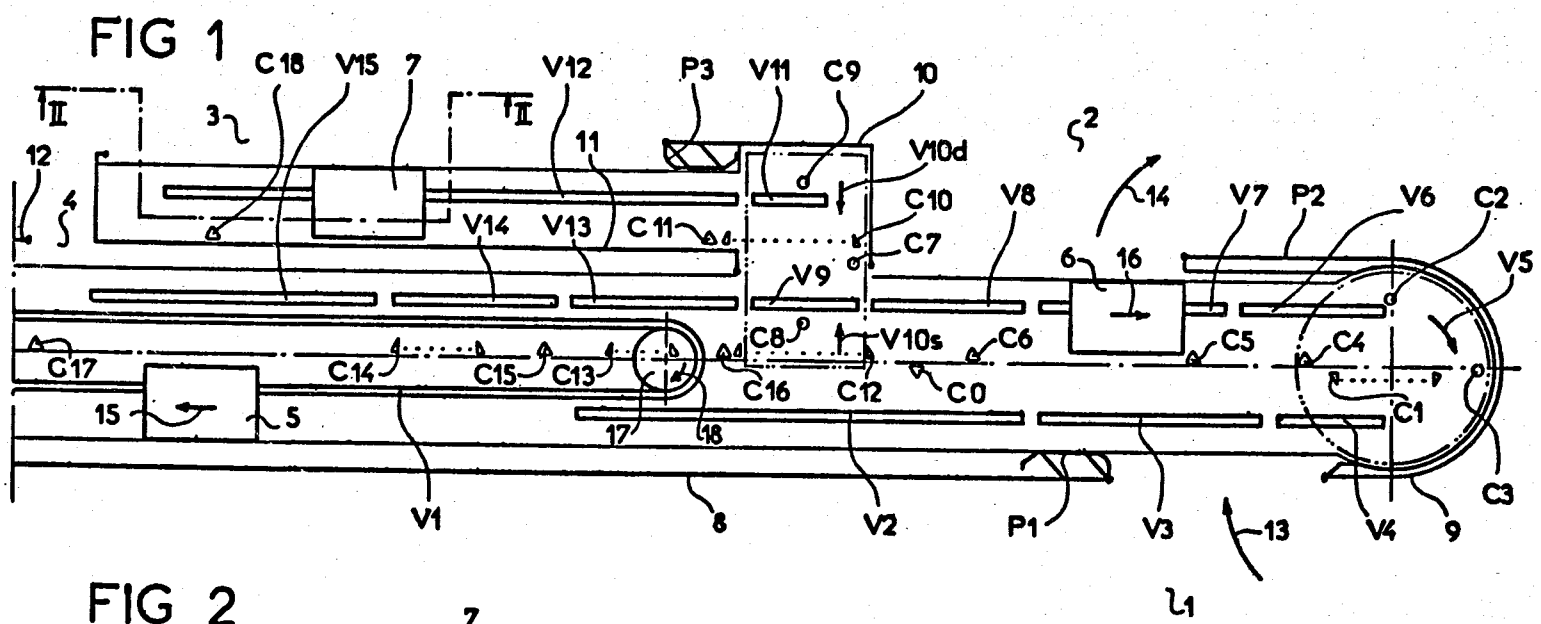
FIG. 1 is a schematic plan view of a terminal station of a transport system.

FIG. 1 is a schematic plan view of a terminal station of an automatic, semi-continuous passenger transport system using passive (non-motorized) vehicles.

In this embodiment, the embarkation platform 1, disembarkation platform 2, parking platform 3 and exit platform 4 communicate with one another. The platforms are separated from the space reserved for movement of vehicles 5, 6 and 7 by rigid barriers 8, 9, 10, 11 and 12 (in the order of the previously-described platforms). Arrows 13 and 14 show the direction of passenger movement on embarkation platform 1 and disembarkation platform 2, respectively. Arrows 15 and 16 respectively show the direction of movement of the vehicle 5 which is leaving the station and the vehicle 6 which is moving past the disembarkation platform.

The station as shown in FIG. 1 comprises 15 active tracks, defined as the moving systems which exert drive forces on the vehicles. Again in the reverse order to that corresponding to the direction of movement of vehicles through the station, these comprise:

- a main (or cruising speed) track V1;
- transit tracks comprising: accelerator track V2, embarkation track V3, turnaround discharge track V4, turnaround track V5, turnaround charge track V6, disembarkation track V7, approach track V8, traverse track V9, variable speed tracks V13 and V14 and decelerator track V15;
- vehicle transfer tracks comprising: transfer track V10, transfer charge-discharge track V11 and vehicle track V12.

Turnaround on main track V1 is achieved by turntable 17, the direction of rotation of which is shown by arrow 18.

Along the route through the station are sensors which detect the presence of vehicles at specific points or within specific areas. These "vehicle position monitoring means" are mounted C0 to C18, in the order corresponding to the direction opposite to the direction of movement of the vehicles.

Embarkation control wall P1, disembarkation control wall P2 and parking control wall P3 are disposed at the ends of the respective platforms of the same name.

Figure 2A:
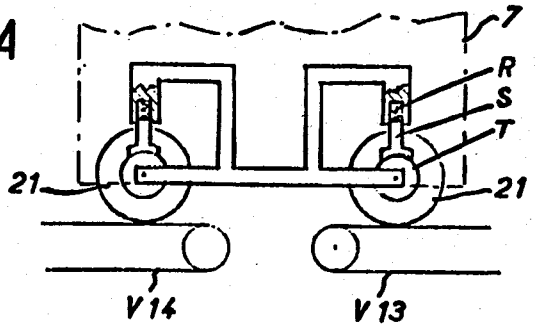
FIG. 2 is an elevation of a vehicle on a single track as shown in FIG. 1 in cross-section on line II—II, and FIG. *2a* is an elevation of a vehicle straddling adjacent tracks.
Figure 2:
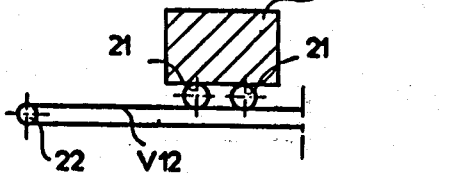

FIG. 2 is a schematic elevation in cross-section on line II—II of FIG. 1, showing the vehicle 7, with two braked wheels 21, the track V12 and a pulley wheel 22. The rails and wheels which support and guide the vehicle 7 are of conventional design and not shown in the diagram.

FIG. 2A is a schematic fragmentary view, partly in section, of the braking system of the wheels of a vehicle 7 when straddling two successive moving tracks V13 and V14. The vehicle 7 comprises two wheels 21 defining independent rotary units rotatably mounted on the chassis and in contact with the successive tracks. When the vehicle 7 is in the position straddling successive tracks, e.g. tracks V13 and V14, nonslip contact the tracks V13 and V14 is ensured by a braking system of the independent rotary units. The braking system comprises a brake drum T fixed for rotation with the respective wheels 21 of the vehicle 7, a brake shoe S guided in the chassis and constantly urged by spring means R into contact with the brake drum T.

Assuming that the vehicle 7 is proceeding from left to right in FIG. 2A and track V14 is a higher speed driving track than track V13 the rear wheel 21 in contact with track V14 will have the tendency to rotate but will be braked by the action of the brake shoe S constantly urged toward the brake drum to ensure slip-free contact with the track V14. This will tend to provide a smooth transition between the tracks V13 and V14 operations at different speeds. Once both wheels are again in contact with the same track (here V13) the vehicle will be moving at the same translatory speed as the track V13 and there will be no rotation of the front wheel relative to the track V13.

The vehicles are driven in the following manner.

The main track V1 (endless cable or chain) and the manner in which the vehicles are linked to the track (clutch-controlled) clamp in the case of a cable, contact lug in the case of a chain) are of conventional design.

Tracks V5 and V10 for vehicle turnaround and transfer, respectively, are also of known design. The space occupied by these is indicated in chain-dotted line (double dots).

The remaining 12 tracks, such as track V12 shown on FIG. 2, are endless loops operating at constant speed. They drive the vehicles such as vehicle 7 through independent braked wheels 21 providing a track-vehicle engagement. The two wheels 21 attached to the vehicle are independent and braked against rotation in a known manner, preferably in a manner which is proportional to the total mass of the vehicle. When a vehicle is moving at a speed different from that of a track such as V12 with which one of the wheels is in slip-free contact, the wheel turns to generate a force which tends to equalize the speed of the vehicle with that of the track. The distance between the two wheels 21 of a vehicle is greater than the distance between successive tracks, so that a vehicle has at least one wheel in contact with one track such as V12 at all times. The two wheels constitute two independent track-vehicle engagement means, facilitating the passage between consecutive tracks irrespective of their respective speeds.

In the following description of the movement of a vehicle in the station, the track speeds are given by way of example only, since an idea of the order of magnitude of these speeds should facilitate the understanding of certain means used to implement the operating method in accordance with the present invention.

The vehicle arrives from the preceding station linked to main track V1 (5 m/s), leaving this track for decelerator track V15 (2 m/s) and then in succession variable speed tracks V14 (2 m/s) and V13 (1.5 m/s), traverse track V9 (1 m/s), approach track V8 (0.7 m/s) and disembarkation track V7 (0.35 m/s). Passengers disembark from the vehicle as it moves at this slow speed. The vehicle then passes over the turnaround charge track V6 (1 m/s), the turnaround track V5, the turnaround discharge track V4 (1 m/s) and then the embarkation track V3 (0.35 m/s). Further passengers embark on the vehicle as it moves at this slow speed. The vehicle then passes over accelerator track V2 (5 m/s) before rejoining the main track V1 (5 m/s) which drives it in the direction of the next station.

The vehicles are independent. The time interval $\delta$ separating consecutive vehicles cannot remain constant. It is therefore necessary to provide at at least one point on the route some means of spacing out vehicles. This may be achieved at the station as shown in FIG. 1 at the time the vehicles are turned around, for example. Vehicles are turned around sequentially. Each vehicle is charged by means of track V6, then immobilized. The turn around is then begun using track V5 and stopped after one half-rotation. The vehicle may then be discharged by means of track V4 while the next vehicle is being loaded in its turn. The turnaround of one vehicle may not be started until time $\Delta$ has elapsed since the start of the turnaround of the preceding vehicle. Time interval $\Delta$ is selected so as to space vehicles out regularly along the entire route.

In the station, sensors C0 to C18 detect the presence of vehicles at certain points or in certain areas. There are three types of sensor:

(1) Track and vehicle point sensor:

Sensors C2, C8 and C9 are of this type, and detect the presence of a specific point on the vehicle at a specific point on the track. They are used to verify that vehicles are exactly positioned before turnaround and transfer.

Sensors C3 and C7 are of the same type and verify that the turnaround and transfer tracks are exactly positioned between successive maneuvers.

(2) Track point, vehicle length sensor:

Sensors C0, C4, C5, C6, C11, C15, C16, C17 and C18 are of this type and detect the presence at a specific point on the track of any point within the overall length of a vehicle.

(3) Track zone, vehicle length sensor:

Sensors C1, C10, C12, C13 and C14 are of this type and cover a certain length of track, rather than a specific point on the track.

These three types of sensor may comprise mechanically-operated switches, proximity detectors, photoelectric cells or any other known means. The sensors of the third type may be implemented by the association of a number of point sensors of the second type.

All the vehicle position sensors C0 to C18 and control walls P1, P2 and P3 provide information needed to implement the operating method in accordance with the present invention. As described in the introductory section, the purpose of this operating method is to provide for stopping a vehicle temporarily in a station, in particular where there is a problem in embarking or disembarking a passenger, without disrupting the movement of passengers already embarked, provided that the fault condition does not exceed a particular duration, which may be unlimited, dependent on the means utilized in the installation.

This elasticity of operation may be achieved in three ways shown in FIG. 1.

(1) Track saturation:

The tracks are stopped as and when they are occupied by vehicles. For example, when track V9 is stopped, track V13 stops when a vehicle reaches sensor C16, then track V14 stops when a vehicle reaches sensor C15.

This method has the disadvantage that it stops and restarts the tracks frequently and is ineffective when the vehicle frequency is close to its maximum value.

(2) Track slowing:

Certain tracks, such as variable speed tracks V13 and V14 in FIG. 1, for example, normally operate at a fast speed but may be operated at a slow speed as soon as an interruption in the embarkation of passengers causes vehicles to accumulate on the upstream side. Switching these variable speed tracks from 2 m/s to 0.7 m/s provides for retarding vehicles on the upstream side by approximately one second for each meter length of track. The number and lengths of the variable speed tracks can be selected as appropriate to each installation.

Figure 4:
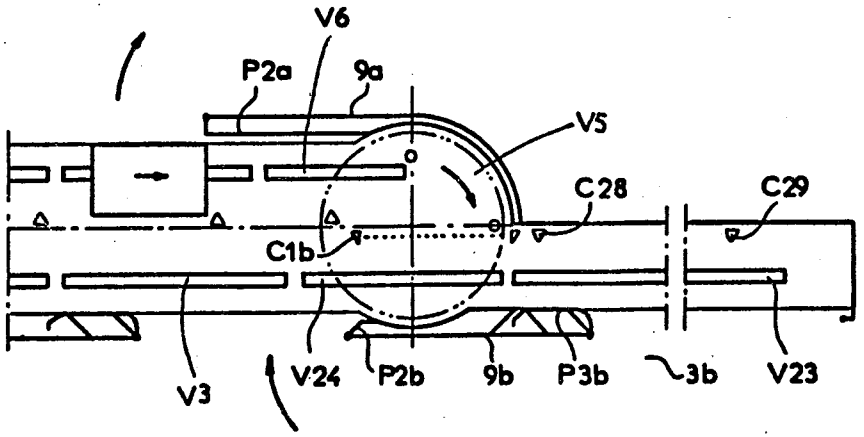

(3) Rerouting and parking:

Vehicles arriving at a saturated station are rerouted and parked on another track, until the tracks on the downstream side of the switch are restarted. The vehicles are re-inserted when a sufficient interval between successive vehicles is detected. In FIG. 1, the parking area can accommodate five vehicles and comprises a turned back section on the upstream side of the disembarkation section. If the parking control wall P3 is retractable during parking, passengers in the vehicles arriving at the station may leave and enter the vehicles at the parking platform 3, with no risk of being prevented from reaching the vehicles. In FIG. 4, the parking area is at the end of the station.

To prevent the need for very large parking areas in each station, the parking of vehicles may be divided between stations. Beyond a certain fault condition duration, the departure of vehicles from another station on the same circuit is interrupted, and vehicles begin to accumulate at that station. The duration involved depends on the respective parking capacities of the stations.

Consider a passenger-generated fault condition of sufficient duration to require the complete vehicle parking sequence followed by the redistribution of vehicles when the fault condition is cleared.

In the description of this sequence and throughout the remainder of this description the qualification "active" refers to the mobile status of the tracks, to the displaced position of the control walls, to tracks V5 and V10 locked by sensors C3 and C7 and to the presence of a vehicle for the other sensors. The qualification "passive" denotes the opposite status.

Consider, for example, a passenger who embarks or disembarks too late, displacing embarkation control wall P1 or disembarkation control wall P2. This movement is detected and immediately causes:

tracks V3, V4, V6 and V7 to be stopped, track V5 to stop at the end of the current rotation, track V8 to stop as soon as sensor C6 is active, track V9 to stop as soon as a vehicle reaches sensor C8.

When a vehicle is stopped on track V9, as soon as the next vehicle reaches sensor C13 track V13 is switched to the slow speed and the vehicle on track V9 is transferred as shown by the arrow V10s until sensor C7 detects the halting and locking of the transfer system in a position which enables the vehicle to be discharged by means of track V11 and then driven by track V12, while the next vehicle in turn reaches the position of sensor C8 of traverse track V9 to be transferred and parked. Vehicles continue to be parked for as long as space remains in the parking area (sensor C18 passive).

As soon as a vehicle reaches sensor C18, track V9 remains stopped. Track V13 stops in turn when a vehicle reaches sensor C12. The stopping of track V13 switches track V14 to the slow speed as soon as a vehicle reaches sensor C14 and stops it as soon as the vehicle reaches sensor C15.

The stopping of track V14 simultaneously stops tracks V15, V2 and V1. All the system as shown in FIG. 1 is then stopped. In particular main track V1 and the vehicles still on it. This situation occurs a significant time after the beginning of the fault condition. It is disagreeable for passengers stopped between two stations and calls for the intervention of supervisory personnel. Even in this situation, however, if the necessary safety conditions are met (vehicles fitted with doors, in particular), the clearance of the fault condition can result in the system being automatically restarted and the vehicles redistributed in the following manner:

Tracks V3 to V8 inclusive restart. When sensor C6 is free, all other tracks start in turn. If track V2 stops when a vehicle pushed by the next vehicle reaches sensor C0, track V3 also stops until sensor C6 is free. Tracks V13 and V14 are restarted at the slow speed. When sensor C14 has not detected any vehicle for a predetermined time interval, track V14 returns to its normal (fast) speed. Track V13 then does the same.

When the variable speed tracks are all running at the fast speed, the detection of a sufficient interval between consecutive vehicles by sensor C17 enables the redistribution of vehicles by the sequence of operations opposite that used to park them described above. When the last parked vehicle has rejoined the normal route the system has returned to its normal status and the effects of the fault condition have been cleared.

Two vehicles are separated by $\delta$, the time interval between the passages of the two vehicles past the same point. At any time the distance between the two vehicles depends on $\delta$, their length L and the average speed of the vehicles between the positions they occupy at this time. For example, in the case of vehicles 2 meters long and for $\delta=6$ seconds, on a main track running at 5 m/s, this distance will be:

$$\delta \times V - L = 6 \times 5 - 2 = 28 \text{ meters.}$$

On the other hand, during the passage at 0.35 m/s past the disembarkation platform, this distance will be: $0.35 \times 6 - 2 = 0.1$ meter. The vehicles are independent. The separation $\delta$ cannot remain constant. Thus, as has already been mentioned, means are provided at at least one point on the route for spreading out vehicles regularly over the entire route. Under normal operating conditions, the variations in the value of $\delta$ between two successive vehicle spreading operations are low, if the speed and acceleration of the vehicles in the variable speed areas vary only slightly.

On the other hand, the operating method in accordance with the invention causes local halts and restarts and may introduce disruptions lasting several seconds.

The time to stop and restart the vehicles and the distance travelled after the stop or restart signal depends on their speed, which varies between approximately 0.35 m/s and 5 m/s. Certain movements such as the turnaround or transfer of a vehicle, are difficult to interrupt before being completely terminated. The track control system must therefore allow for two hazards introduced by such disruptions:

the risk of collision in the areas where vehicles approach one another, that is to say in the deceleration areas, the risk that it will not be possible to transfer vehicles to the parking area because of a vehicle immobilized between tracks V9 and V8.

The following means, shown in FIG. 1, are proposed to overcome this:

(1) In stopping, track V9 authorizes the passage of a vehicle beyond sensor C8 only if sensor C6 is passive, so ensuring that one vehicle length is available on the downstream side of the position of the vehicle ready to be transferred. Track V9 thus spaces out the vehicles so that the time interval $\delta$ between the vehicle passing sensor C8 and the preceding vehicle is greater than or equal to the time interval $\Delta e$ separating vehicles on track V7 ($\delta \geqq \Delta e$).

(2) Stopping track V9 may result in the parking of the stopped vehicle, and the slowing and stopping of variable speed tracks V13 and V14, as already described.

(3) If $\Delta c$ is the collision time interval at the minimum speed, namely six seconds for vehicles two meters long at 0.35 m/s, then if $\Delta e < \Delta c$, the difference $\Delta c - \Delta e$ is made up without inconveniencing passengers by selecting the speed of approach track V8 slightly greater than that of track V7, so that the difference in speed between tracks V7 and V8 results in only a "gentle" collision, easily absorbed by the buffers on the vehicles.

(4) Charging track V6, like variable speed tracks V13 and V14, operates at two speeds, a slow speed of 0.35 m/s during rotation of the turntable and a fast speed of 1 m/s as soon as the table is locked in position. The time vehicles remain on track V6 is thus variable, which allows for making up a small discrepancy $\Delta - \delta$ (where $\Delta$ is the separation in time of vehicles imposed by spreading them out). If the discrepancy to be made up exceeds what can be achieved using track V6, then this track stops when a vehicle reaches sensor C4 and does not restart until the current turnaround is terminated. Track V7 stops if a vehicle reaches sensor C5 while track V6 is stopped. If the accumulating vehicles reach a far as sensor C6, then track V9 and the upstream tracks are controlled in the manner already described.

(5) The slow speed of variable speed tracks V13 and V14 (approximately 0.7 m/s) is selected so that a very small value of $\delta$ (up to $\delta = 3$ seconds) between consecutive vehicles prevents them colliding on the variable speed tracks.

(6) To facilitate the redistribution of vehicles accumulating in the station, the time required for the main track when restarted to run up from null speed to its normal speed exceeds the time taken to run down from the normal speed to null speed after the stop signal. Allowing for the transient phases, the speed of accelerator track V2 is with advantage maintained continuously equal to that of main track V1, by means of a servo-control system or a mechanical link between the two tracks.

The exact operating conditions for the tracks shown in FIG. 1 are specified by the logical equations in table A. The "passive" terms are overscored. Functions subject to a time-delay cannot be represented in the same form as the others, and the appropriate wording is included in the inequality. For example, "C14 for t<t13" means "sensor C14 passive for time t less than t—". Terms t9, t13, t14, t17, tr and td correspond to the values to which the time-delays are set. Certain complex and repetitive intermediate functions are also shown, with their logic equation, in this table.

It is a simple matter to translate the logic equations of table A into practical control circuits.

TABLE A

| Symbol | Function | Logic equation |
|---|---|---|
| V1 | Main track | $V1 = V141 + V14r$ |
| V2 | Accelerator track | $V2 = V141 + V14r$ |
| V3 | Embarkation track | $V3 = N\,(V2 + \overline{CO})$ |
| V4 | Turnaround discharge track | $V4 = N$ |
| V5 | Turnaround track | $V5 = \overline{P2}\,(\overline{C1}\,C2\,Kr + V5\,\overline{C3})$ |
| V6r | Turnaround track load (fast) | $V6r = N\,C3\,\overline{C2}$ |
| V61 | Turnaround track load (slow) | $V61 = N\,\overline{C4}\,(\overline{C3} + C2)$ |
| V7 | Disembarkation track | $V7 = N(V6r + V61 + \overline{C5})$ |
| V8 | Auproach track | $V8 = V7 + \overline{C6}$ |
| V9 | Traverse track | $V9 = C7\,(\overline{C8} + \overline{C6}\,V7)$ |
| V10s | Parking transfer | $V10s = C8\,\overline{V9}\,\overline{C10}\,C13\,\overline{C18} + V10s\,\overline{C7}$ |
| V11s | Transfer discharge | $V11s = C7\,C10\,\overline{D}$ |
| V12s | Parking translation | $V12s = V10s + V11s$ |
| V12d | Parking exit translation | $V12d = \overline{P3}\,(V11d + \overline{C11})$ |
| V11d | Parking exit charging | $V11d = C7\,\overline{P3}\,D\,\overline{C9}$ |
| V10d | Parking exit transfer | $V10d = C9\,D\,\overline{C12}\,\overline{C13}\,\overline{C14}\,\overline{C15} + V10d\,\overline{C8}$ |
| V131 | Variable speed track V13, slow speed | $V131 = (V9 + \overline{C16})\,([L + \overline{V9}\,C13] + V131\,[C13 + (\overline{C13}\text{ for } t < t13)])$ |

TABLE A-continued

| Symbol | Function | Logic equation |
|---|---|---|
| V13r | Variable speed track V13, fast speed | $V13r = (V9 + \overline{C16})\ \overline{V131}$ |
| V141 | Variable speed track V14, slow speed | $V141 = (V131 + V13r + \overline{C15})\ (L\ C15 + \overline{V131}\ \overline{V13r}\ C14 + V141\ [C14 + (C14 \text{ for } t < t14)])$ |
| V14r | Variable speed track V14, fast speed | $V14r = (V131 + V13r + \overline{C15})\ \overline{V141}$ |
| V15 | Decelerator track | $V15 = V141 + V14r$ |
| I | Activation of system by operator | |
| N | Normal operating conditions signal | $N = \overline{P1}\ \overline{P2}\ \overline{I}$ |
| Kr | Turnaround timing signal | $Kr = (V5\ \overline{C2} \text{ from } t < tr$ |
| Kd | Parking exit timing signal | $Kd = (V10d\ \overline{C9} \text{ from } t < td)$ |
| T | Parking exit gap signal | $T = (\overline{C17} \text{ for } t > t17)$ |
| D | Parking exit signal | $D = V13r\ V14r\ (T\ Kd + DC7)$ |
| L | Slow speed start of variable speed track signal | $L = C16\ (V9 \text{ for } T < t9)$ |

Figure 18:
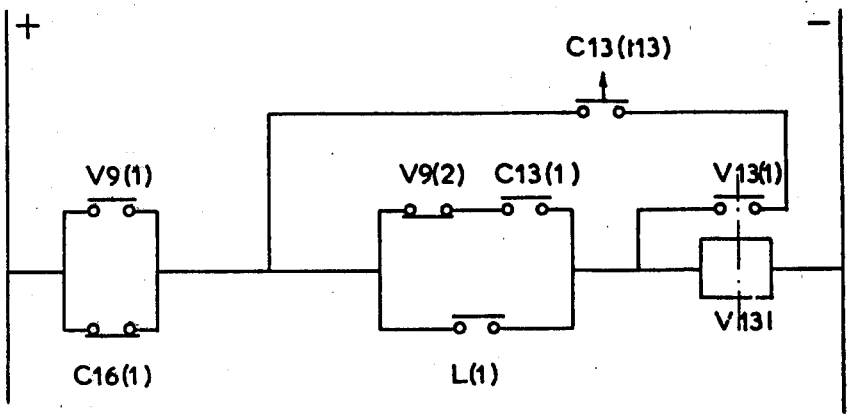
FIG. 18 is a schematic circuit diagram of the control system for one track.

By way of example, FIG. 18 shows the electrical circuit diagram corresponding to one of the most complex logic equations (V131), describing the operation of variable speed track V13 at the slow speed. Referring to FIG. 18, coil V131 is fed from + and − power rails through the following contacts:

| | |
|---|---|
| V9(1), C13(1), L(1), V131(1) | normally open |
| C16(1), V9(2) | normally closed |
| C13(t13) | normally open with time-delay t13 on dropping out. |

The contacts are shown in the unoperated position, corresponding to the passive state of the controlling elements. For example, contact V9(1) is open when track V9 is passive and closed when it is active.

FIG. 18, corresponding to logic equation V131, shows that the variable speed track V13 is operated at the slow speed when its coil V131 is live, in other words when:

| | | |
|---|---|---|
| V9 is active | and | V9 is passive and C13 active |
| or C16 is passive | or | L is active |

The righthand term is stored by V131, so that slow speed operation of track V13 may terminate either on the simultaneous presence of track V9 passive and sensor C16 active or on sensor C13 remaining passive for a time t exceeding t13, if the righthand term is no longer true.

In more concrete terms, variable speed track V13 is stopped if the traverse track V9 on its downstream side is stopped and if a vehicle has reached sensor C16. Variable speed track V13 starts at the slow speed when the traverse track begins to move (track V9 and L active). If variable speed track V13 is operating at the fast speed, it may be switched to the slow speed when track V9 stops and a vehicle reaches sensor C13. Once track V13 is operating at the slow speed, it continues to do so until sensor C13 detects a time interval between two vehicles exceeding t13, indicating that it may return to the fast speed, or, until traverse track V9 stops and a vehicle arrives at sensor C16, which stops track V13.

Figure 3:
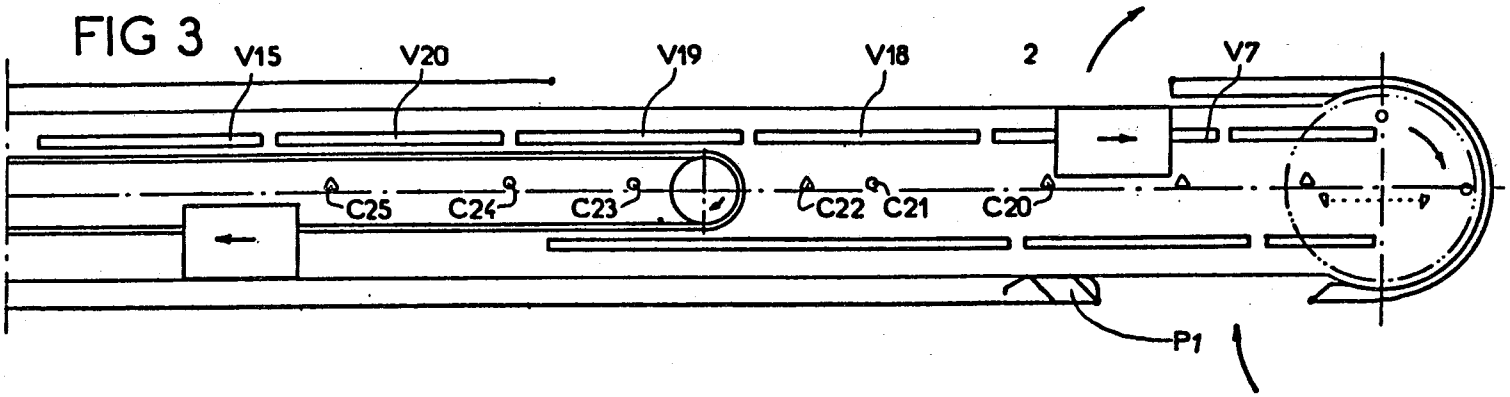
FIGS. 3 and 4 are variations on FIG. 1.

FIG. 3 is a plan view analogous to FIG. 1, with a different arrangement of the tracks and platforms such that the disembarkation platform 2 is extended alongside variable speed tracks V18 and V19. A spreading variable speed track V20 is situated on the upstream side of variable speed track V19. Tracks V15 and V7 and all tracks on the downstream side of track V7 are identical to those of FIG. 1, to which reference should be had for a description thereof. Sensors C20, C21, C22, C23, C24 and C25 as shown on FIG. 3 are not shown in FIG. 1.

The arrangement of the station as shown in FIG. 3 is a particularly compact embodiment of the invention. Variable speed tracks V18 and V19 are substantially the length of two vehicles. Their fast speed is approximately 2 m/s, like variable speed tracks V13 and V14 in FIG. 1. On the other hand, their slow speed is equal to that of the disembarkation track V7, approximately 0.35 m/s. To some extent the disembarkation platform is of variable length, starting where the vehicle is running at the slow speed (0.35 m/s). Under normal operating conditions, it is limited to the length of travel of the vehicle on track V7. When vehicles accumulate, its length increases. In the case of vehicles without doors, the deceleration from 2 m/s to 0.35 m/s clearly indicates that the vehicle is about to stop. In the case of vehicles fitted with doors, the point at which the doors are opened may be situated after the variable speed track is switched to the slow or fast speed.

Operation is as follows: When the disembarkation track V7 stops, the variable speed reducer track V18 switches to the slow speed. It stops when one vehicle has reached sensor C20 and another has reached sensor C21. When track V18 stops, variable speed track V19 is switched to the slow speed, and stops in its turn when one vehicle has reached sensor C22 and another has reached sensor C23. When track V19 is stopped, a vehicle reaching sensor C25 stops the main track. When track V7 restarts, tracks V18 and V19 restart at the slow speed and are switched to the fast speed when sensor C21 and then sensor C23 detect a sufficient time interval between consecutive vehicles.

condition at the end of the disembarking stage detected by wall P2*a*. Parking is effected as follows: When a vehicle has been turned around by means of track V5, if track V3 is stopped the vehicle moves off in the opposite direction, driven by track V24 and then track V23. The retrieval of vehicles from the parking area is achieved by the reverse procedure, controlled similarly to this operation in FIG. 1.

TABLE B

| Symbol | Function | Logic equation |
|---|---|---|
| V181 | Track V18, slow speed | $V181 = (V7 + \overline{C20} + \overline{C21})(C20\ C21 + \overline{V7} + V181\ [C21 + (\overline{C21}\ \text{for}\ t < t18)])$ |
| V18r | Track V18, fast speed | $V18r = (V7 + \overline{C20} + \overline{C21})\ \overline{V181}$ |
| V191 | Track V19, slow speed | $V191 = (V181 + V18r\ \overline{C22} + \overline{C23})(C22\ C23 + \overline{V181}\ \overline{V18r} + V191\ [C23 + (\overline{C23}\ \text{for}\ t < t19)])$ |
| V19r | Track V19, fast speed | $V19r = (V181 + V18r + \overline{C22} + \overline{C23})\ \overline{V191}$ |
| V201 | Track V20, slow speed | $V201 = (V191 + V19r + \overline{C25})(C25\ C23\ C22 + C24 + V201\ [C24 + (\overline{C24}\ \text{for}\ t\ t20)])$ |
| V20r | Track V20, fast speed | $V20r = (V191 + V19r + \overline{C25})\ V201$ |

With the station as shown in FIG. 3 it is no longer possible to spread out the vehicles without collisions as was done by tracks V8 and V9 in FIG. 1. In FIG. 3 this function is provided by the spreading track V18. This is a two-speed track like the other variable speed tracks, and it switches to the slow speed immediately after the passage of each vehicle, as the vehicle reaches sensor C22, and does not return to the fast speed for a period t18. Any vehicle too close to the preceding vehicle is retarded by track V18. If the length of track V18 is 4 meters and its speeds are 2 m/s and 0.6 m/s, the delay may be up to 3.5 s. Where appropriate, selection of the slow speed may be implemented only if a too short interval between two vehicles is detected.

As with FIG. 1, the operating conditions of tracks V18, V19 and V20 of FIG. 3 at the slow and fast speed modes are represented by the logic equations of table B.

FIG. 4 is analogous to FIG. 1 and shows a vehicle parking area at the end of a station. The rigid barrier 9 is replaced by two barriers 9*a* and 9*b*. The new tracks comprise a parking charge-discharge track V24 and a parking-parking exit translation track V23. Control wall P2 is replaced by two walls P2*a* and P2*b*. A wall P3*b* is disposed at the end of a parking platform 3*b*. Sensors C1*b*, C28 and C29 shown in FIG. 4 ane not shown in FIG. 1. All the other tracks, sensors, vehicles, etc are identical to those of FIG. 1, to which reference should be had for a description thereof.

Only the ends of the parking area are shown in FIG. 4 and whereas the parking area is simpler than that of FIG. 1, it does not provide for parking vehicles during an interruption in embarking passengers due to a fault A similar parking area extending track V6 could be added to replace the parking area extending track V3 previously described.

As for FIGS. 1 and 3, the precise operating conditions of tracks V23 and V24 and the modifications in respect of tracks V6 and V7 are given in logic equation form in table C.

The specific characteristics of each passenger transport installation will condition the combination of the various means previously described selected so as to introduce a certain degree of elasticity. The timing of vehicles, their capacity, the distance between stations, topographical features, supervisory facilities and investment are all factors affecting the selection of the number and positions of variable speed tracks, and whether an external parking area is provided and if so its position.

The objective is always to minimize intervention by supervisory personnel and the stopping of vehicles between stations in the case of fault conditions due to passengers, by slowing and stopping the tracks and where necessary by parking vehicles externally.

These arrangements minimize the consequences of passenger-generated fault conditions. FIGS. 5 to 17 show various specific means for detecting these fault conditions, these being intended to reduce the risk that such conditions will occur and to facilitate the rapid correction of passenger behaviour.

To this end, in order to avoid as often as possible stopping a vehicle and interrupting embarkation, an embodiment of the controls walls in accordance with the invention is designed to first signal the danger to the passenger without immediately stopping the vehicle.

TABLE C

| Symbol | Function | Logic equation |
|---|---|---|
| V6r | Turnaround charge, fast speed | $V6r = \overline{P2a}\ C3\ \overline{C2}$ |
| V61 | Turnaround charge, slow speed d | $V61 = \overline{P2a}\ \overline{C4}\ (\overline{C3} + C2)$ |
| V7 | Disembarkation | $V7 = \overline{P2a}\ (V6r + V61 + \overline{C5})$ |

TABLE C-continued

| Symbol | Function | Logic equation |
|---|---|---|
| V24s | Parking exit | $V24s = \overline{P2b}\ \overline{V3}\ \overline{C29}\ C3\ Clb$ |
| V24d | Parking exit | $V24d = \overline{P2b}\ \overline{V24s}$ |
| V23s | Parking translation | $V23s = (\overline{V3}\ V5 + V24s)\ \overline{P2b}$ |
| V23d | Parking exit translation | $V23d = \overline{P2b}\ \overline{P3b}\ (\overline{C28} + C3\ Db)\ \overline{V23s}$ |
| Db | Parking exit signal | $Db = Tb\ Kb + Db\ C28$ |
| Tb | Parking exit gap signal | $Tb = (\overline{C5}\ \text{for}\ t > t5)$ |
| Kb | Parking exit timing signal | $Kb = \overline{(Clb\ \text{from}\ t < tb)}$ |

The boundary between the areas tripping the signaling system and stopping the vehicle are analogous to the successive enclosing walls of a fortified castle.

Figure 5:
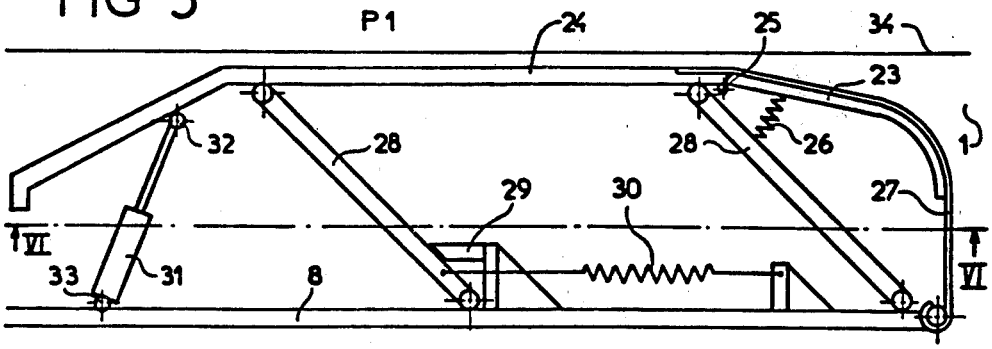
FIG. 5 is a plan view of a control wall.

FIG. 5 is a plan view showing in more detail control wall P1 at the end of embarkation platform 1 as shown in FIGS. 1 and 3. Control wall P1 comprises a curved upstream signaling panel 23 and a stop downstream panel 24 connected together by a hinge 25, and associated with a compression spring 26 and a flexible strip 27. The control wall is pivotally attached to the rigid barrier 8 by links 28. A stop 29 projects from the barrier 8 in line with one of the links 28, to which a traction force is applied by a spring 30. A piston and cylinder actuator 31 is pivoted by shafts 32 and 33 to control wall P1 and barrier 8, respectively. The flexible strip 27 is attached at one end to stop panel 24 and at the other end to barrier 8. Over the greater part of its length stop panel 24 is parallel to and at the same level as the edge 34 of the embarkation platform 1.

Figure 6:
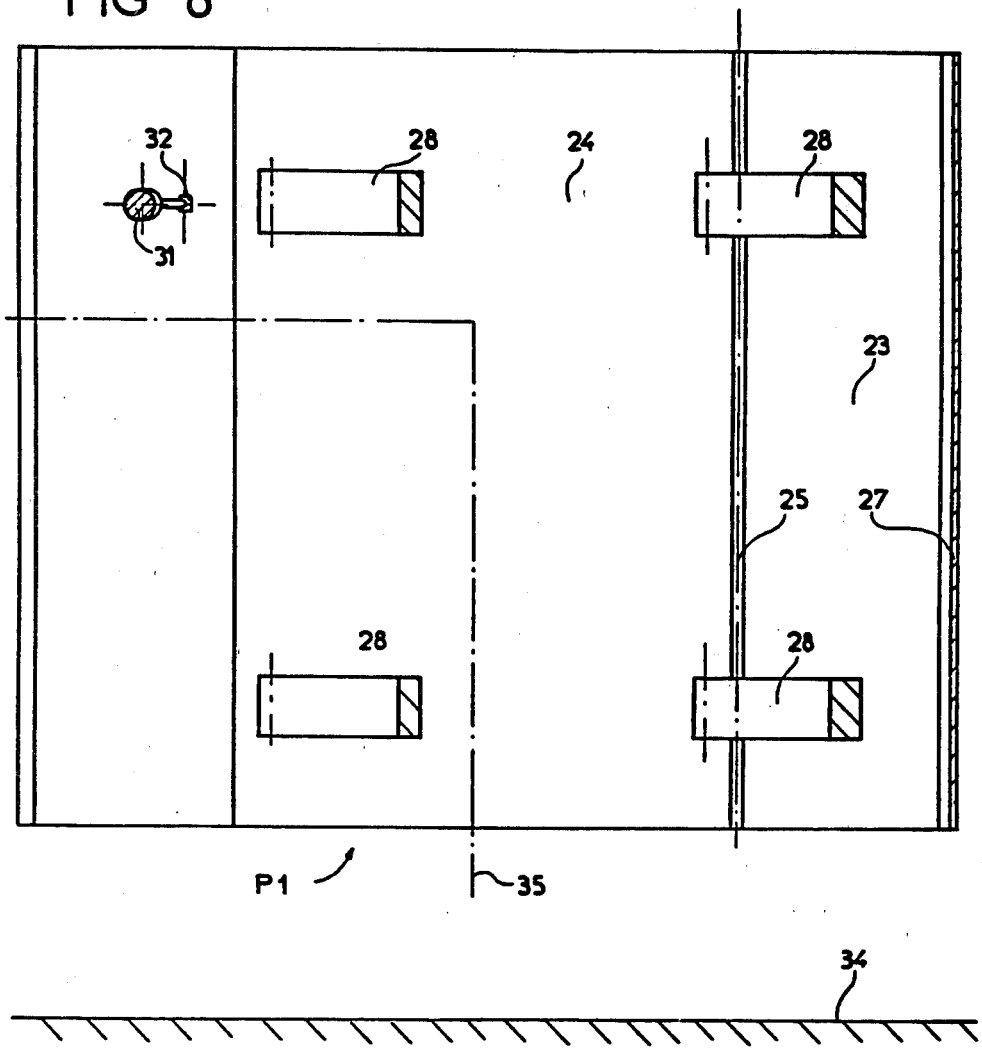
FIG. 6 is an elevation in cross-section on line VI—VI in FIG. 5.

FIG. 6 is an elevation in cross-section on line VI—VI of FIG. 5, showing some of the elements also shown in that figure. The level of the platform is shown by its edge 34. The chain-dotted line 35 indicates a part of control wall P1 which is omitted in the embodiment shown in FIGS. 9 and 10. In this case, the wall has only three pivoted links 28, not four.

The control wall P1 provides a visual indication of the end of embarkation platform 1. It also detects passenger-generated fault conditions on embarkation in the following manner:

If a passenger is embarking too late or has some part of his body projecting beyond the vehicle at the end of platform 1, he presses against control wall P1, which is pivoted by means of links 28. Stop panel 24 is maintained in its unoperated position by the tension spring 30 holding one of the links 28 against the stop 29. The unoperated position of signaling panel 23 is produced by the opposite actions of the compression spring 26 and the tensioned flexible strip 27. Any movement of signaling panel 23 or stop panel 24 is detected by conventional means (not shown), such as mechanical switches, for example.

Movement of the stop panel interrupts embarkation as follows:

- embarkation track V3 is stopped immediately and vehicles accumulate on its upstream side, as described above with reference to FIGS. 1, 3 and 4;
- the fault condition is signaled locally, visually, audibly or in any other way, encouraging the passenger to move to a safe position, either inside the vehicle or on the platform. The passenger is then no longer pressing against the stop panel, which returns to its unoperated position which results (possibly after a short time-delay) in the restarting of the first track stopped and the progressive redistribution of the vehicles on its upstream side.

If the passenger moves signaling panel 23 but not stop panel 24, the signaling system is tripped but the vehicle is not stopped, which avoids stopping for a large number of fault conditions which can be corrected quickly by the passengers. The panel 23 is mounted so that its displacement, requiring little force, impedes to the least possible extent the movement of the passenger causing the fault condition and facilitates his embarkation. The flexible strip 27 eliminates sharp edges and so prevents snagging of clothes or parcels, whatever the position of the walls.

A simplified version of this control wall, still within the scope of the invention, could comprise a single panel acting as the stop panel.

Other means might be added to or replace panels 23 and 24 for controlling the signaling system and interruption of passenger embarkation, such as, for example, an arrangement for interrupting a light beam falling onto a photo-electric cell or weight sensors in certain sensitive areas of the platform.

Figure 8:
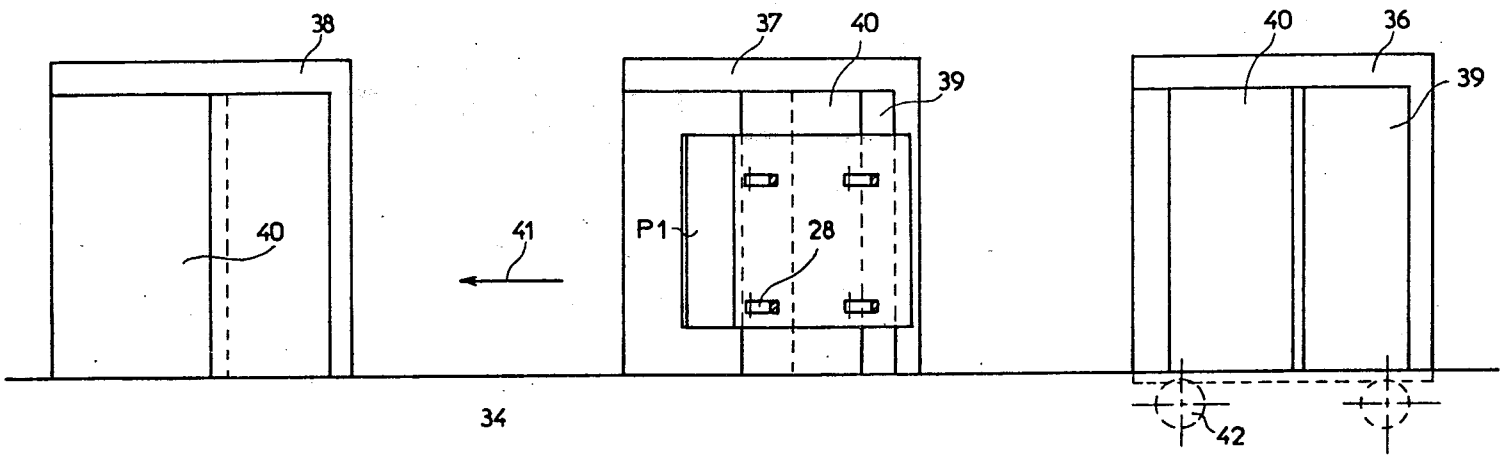
FIG. 8 is an elevation in cross-section on line VIII—VIII in FIG. 7.
Figure 7:
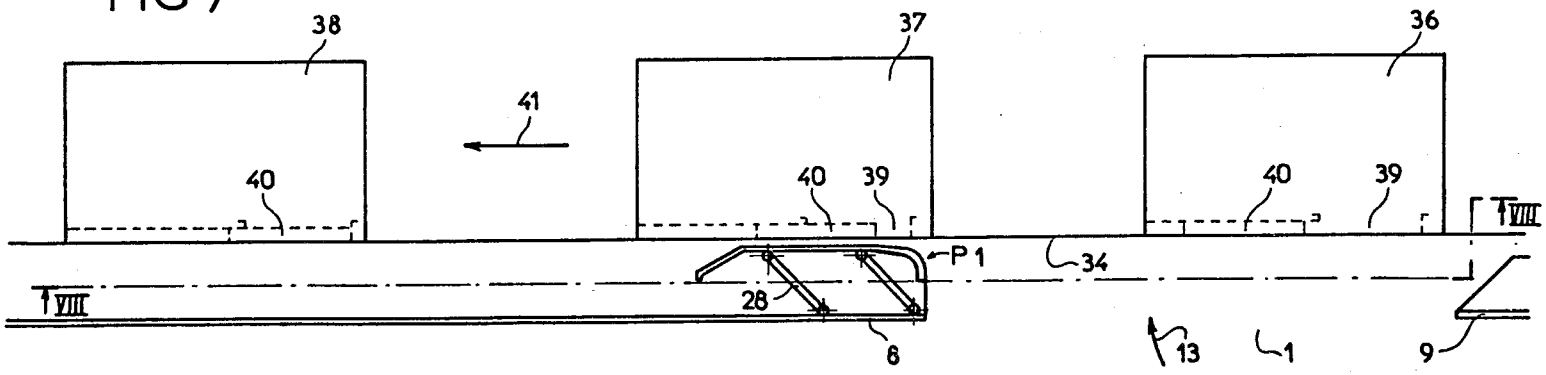
FIG. 7 is a schematic plan view of a station, in the vicinity of a control wall, in which are located three vehicles fitted with sliding doors.
Figure 10:
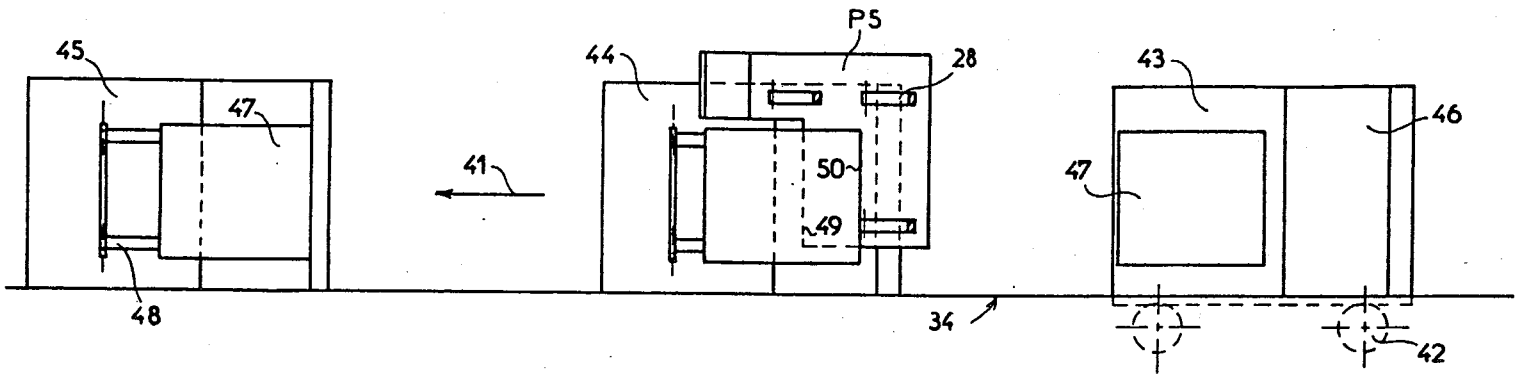
FIG. 10 is an elevation in cross-section on line X—X in FIG. 9.
Figure 9:
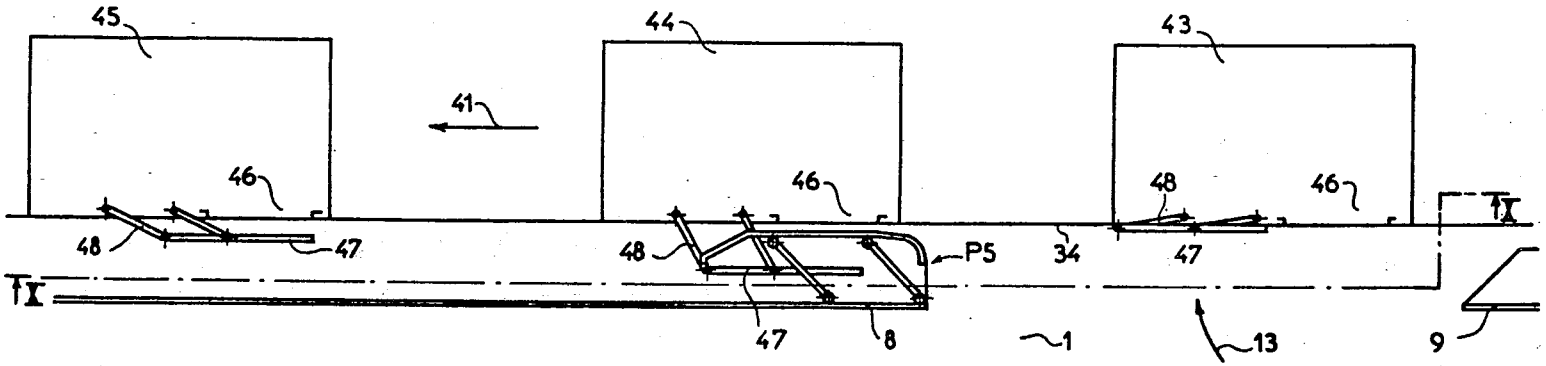
FIG. 9 is a schematic view similar to FIG. 7, showing three vehicles with pivoted sideways opening doors.

In the case of vehicles fitted with doors, the doors are closed as the opening in the vehicle moves past the control wall P1, which guarantees that nothing will project to a significant extent beyond the opening in the vehicle. FIGS. 7 and 8 show the closing of the door in the case of a conventional elevator-type door. FIGS. 9 and 10 show an original embodiment of the door which moves behind the control wall as it closes.

FIG. 7 shows the embarkation platform 1, its edge 34, the rigid barriers 8 and 9 around the edge of the platform, the control wall P1 and its pivoted links 28 and three vehicles, 36, 37 and 38, each with an opening 39 and door 40; the arrow 13 shows the direction of movement of passengers. The arrow 41 shows the direction of movement of the vehicles.

FIG. 8 is an elevation in cross-section on line VIII—VIII of FIG. 7, showing certain elements also shown in the latter. That part of the vehicle 36 beneath the platform level 34 is shown in dashed outline, including in particular two support wheels 42.

The three vehicles, 36, 37 and 38 are respectively in front of the embarkation platform 1, with door 40 open, in front of the control wall P1 with door 40 closing and downstream of the wall P1 with door 40 closed. The doors 40 are sliding doors as conventionally used for elevators. They are closed as the vehicles move in front of the control wall P1. More specifically, defining the upstream edges of the door 40 and the control or safety wall P1 as those edges of the door and safety wall facing the direction from which the vehicle has come, the door closes when the upsteam edge of the door is in a position downstream from the upstream edge of the safety wall member. In this way, the safety wall member effectively gradually closes off access to the vehicles and prevents passengers from interfering with the operation of the door. Any impediment to closing, reflected in a force exceeding a preselected value, according to a known technique in the field of elevators, interrupts the closing of the doors and has the same consequences as movement of the stop panel 24: the vehicle is stopped, vehicles accumulate, the fault condition is signaled. However, the presence of wall P1 in front of the opening considerably reduces the risk of an obstacle (passenger or parcel) impeding the closing of the door.

FIGS. 9 and 10 are analogous to FIGS. 7 and 8, showing three vehicles 43, 44 and 45 fitted with laterally pivoted doors 47 for closing their respective openings 46, instead of sliding doors. In addition to the elements already described with reference to FIGS. 7 and 8, also shown are pivot arms 48 of door 47 which form a deformable parallelogram, so that door 47 remains parallel to the edge of the platform throughout its movement. A control wall P5 replaces wall P1 of FIGS. 7 and 8. The wall P5 is identical to the wall P1 except that the part indicated by the chain-dotted line 35 in FIG. 6 is omitted, to define a vertical edge 49 on the downstream side. The door 47 has a vertical edge 50 on the upstream side. When, as a result of the movement of the vehicle, the edge 50 of the door passes the edge of the wall P5, the door 47 begins to close, moving behind the wall P5, the mechanism implementing this operation being described in more detail below. This makes it more difficult for passengers to impede the closing of the door.

Figure 11:
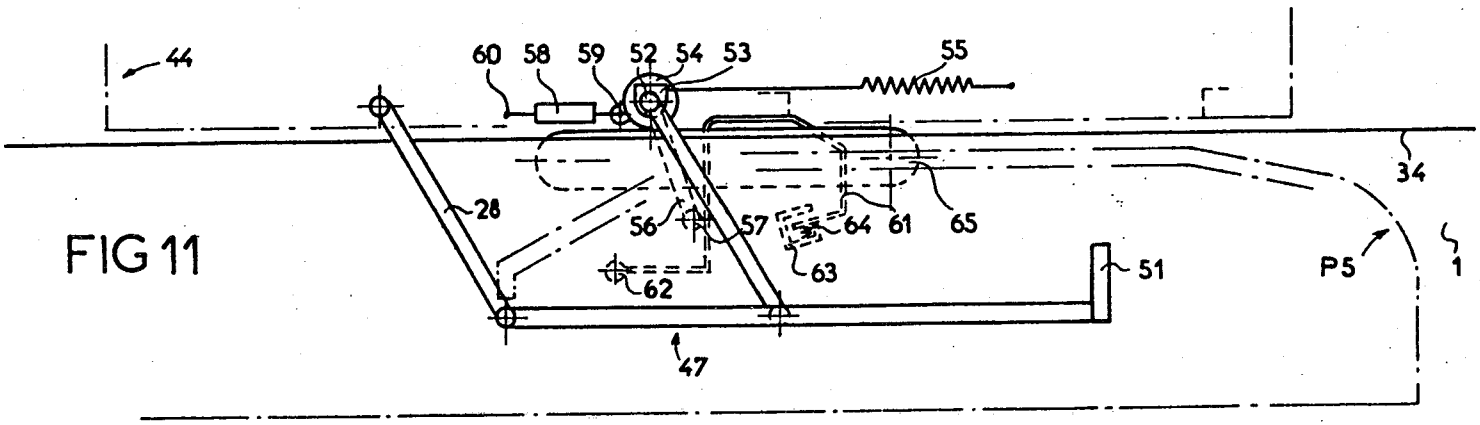
FIG. 11 shows part of FIG. 9 to a larger scale, showing the door of a vehicle and its control mechanism.

FIG. 11 shows part of FIG. 9 to a larger scale, showing the door 47 of the vehicle 44 in the process of closing, with its control mechanism. In this specific embodiment of the mechanism in accordance with the invention, the active (motorized) part is the track, the vehicle comprising only passive components. The mechanism comprises a latching pin 51, the pivot arms 28, a main shaft 52, a bearing 53, a wheel 54, a tension spring 55, a support arm 56 carrying a roller 57 and a shock absorber 58 pivoted by shafts 59 and 60, respectively, to the main shaft 52 and to the chassis of the vehicle (not shown). Below the edge 34 of the platform 1 is a support track 61 pivoted on a shaft 62 and maintained in position at the other end by a stop 63 and compression spring 64. Also beneath the platform, a drive band constant speed 65 rotates the wheel 54 as it passes.

To avoid overcomplicating FIG. 11, only the outside surfaces of the vehicle 44 and the wall P5 are shown, in chain-dotted line.

Figure 12:
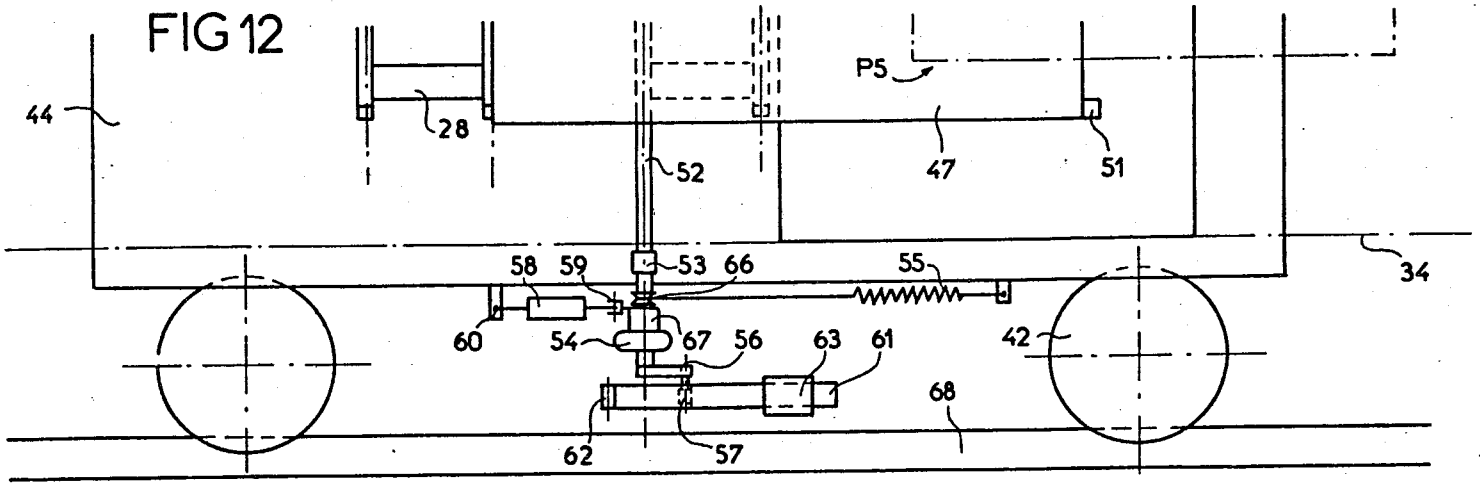
FIG. 12 is an elevation corresponding to FIG. 11, showing only those components forming part of the vehicle.

FIG. 12 is an elevation corresponding to FIG. 11, but showing only the elements on the vehicle 44. In addition to the elements already described with reference to FIG. 11, also shown are a pulley wheel 66 and a clutch 67, advantageously of the "torque limiter" type. The wheels 42 of the vehicle 44 are supported on a rail 68. The outside surface of the wall P5 and the platform edge 34 are shown in chain-dotted outline.

The door as shown in FIGS. 11 and 12 closes in the following manner: When in front of the embarkation platform 1, the door 47 of the vehicle 44 is held open by the tension spring 55, the end of which is wound around and attached to the pulley wheel 66. At the end of the platform the vehicle 44 passes the wall P5. As soon as the door 47 is disengaged from the control wall P5, the wheel 54 reaches the drive band 65 which causes it to rotate at constant speed, to start closing the door. The main shaft 52 is supported on the chassis of the vehicle 44 in bearings 53. The pivot arms 28, the support arm 56 and the associated pivot shaft of the shock absorber 59 all rotate with the main shaft 52. When the wheel 54 rotates, it exerts through the clutch 67 a constant torque which is greater than and opposite in direction to that of the spring 55 which maintains the roller 57 of the support arm 56 on the support track 61 until the pin 51 latches. To each position of the vehicle there corresponds a position of the roller 57 and the support arm 56, and thus a position of the door. Any impediment or malfunction in the closing of the door causes the roller 57 to move away from the track 61. Under the action of the spring 64, the track 61 moves slightly inside the stop 63. This movement is detected by known means (not shown) and causes embarkation to be interrupted, as described above, when the vehicle is in a position implying that closure of the door is in progress (roller 57 in contact with track 61).

The drive band 65 is not needed to open the door. After the door is unlatched by known means (not shown), the door is opened by the action of spring 55, damped by shock absorber 58.

In the embodiment shown in FIGS. 11 and 12, latching is effected by a pin 51 which attaches to the vehicle at the end of door closure by known means (not shown). As a variant, the door could close completely after disengagement from the control wall.

If the control wall is at the end of the parking platform, as is wall P3 in FIG. 1, it is necessary for vehicles to be able to move past the wall with the doors closed, in the direction opposite to that shown in the preceding figures. A vehicle could be parked by retracting the control wall using the actuator 31 of FIG. 5 and retracting the support track 61 by analogous means (not shown in FIG. 11) acting on the stop 63.

FIGS. 13, 14 and 15 are views in elevation of vehicles in a position analogous to that of vehicle 44 in FIG. 10.

FIG. 13 shows a control wall 69 and a vehicle 70 fitted with a door 71 terminating in a pin 72.

FIG. 14 shows a control wall 73 and a vehicle 74 fitted with a door 75 terminating in two pins 76.

FIG. 15 shows a control wall 77 and a vehicle 78 fitted with a door 79 terminating in two pins 80 carried on bars 81 and 82.

These three figures show various embodiments of the doors and control walls. It may be beneficial to use doors and control walls which interleave in a "comb" configuration to provide a longer overlap between the door and the wall, especially when the door is latched by means of pins at its edge.

The vehicle 70 shown in FIG. 13 is identical to the vehicle 44 shown in FIG. 10, except that the latch pin 72 is central and the control wall 69 extended downwardly.

In FIG. 14, the door 75 carrying two pins 76 is partially cut away in its central portion to permit the passage of part of the control wall 73.

In FIG. 15 the arrangement of FIG. 14 is extended to the extreme case whereby the part of the door which closes the opening is reduced to the two bars 81 and 82.

FIGS. 16 and 17 are schematic representations in elevation, seen in the direction perpendicular to the direction of movement of the vehicles, showing a vehicle 83, its wheels 42, its door 84 and the control wall 85. In this "visor" type door mechanism, the door 84 moves behind the wall 85 as in the lateral door mechanism described in detail with reference to FIGS. 9 to 14, but vertically instead of sideways. The visor-type door is open in FIG. 16 and closed in FIG. 17. This type of door is beneficial in certain applications, for example if the opening in the vehicle is to be very wide, extending almost the full length thereof.

The invention is naturally not limited to the above description which is given by way of example only. Thus in certain specific embodiments, the two stations normally provided as a minimum are merged as a single outgoing and incoming station of a closed loop circuit, as used for scenic tours, for example.

A passenger-generated fault condition is detected when an object projects beyond a "vehicle access boundary surface". This surface may be associated with the platform (control wall, for example) or the vehicle (theoretical door position). In the foregoing description, the door is closed when the opening in the vehicle is substantially opposite a control wall, although this does not exclude the conventional arrangement in which there is no such wall (elevator doors, for example).

In the foregoing description, the drive systems referred to as variable speed tracks have three possible operating conditions: normal speed, slow speed, stopped. Using a similar automatic control system, flexibility of operation could be enhanced by the use of drive systems able to operate at one or more further predetermined speeds between the normal speed and the slow speed.

Furthermore, in the embodiment described, most of the vehicle drive tracks are of endless loop form. This option is non-limiting, and other embodiments, well-known in handling systems, may be used instead (chains, cables, drive wheels).

I claim:

1. An automatic method of operating a semi-continuous passenger transport system having successive movable tracks for driving non-motorized vehicles along a closed path between at least two stations, said tracks including cruising speed tracks located between said stations, slow speed tracks at embarkation and disembarkation platforms located at each of said stations, and transition tracks for accelerating and decelerating said vehicles at the ends of said platforms; said transport system further including structural means for limiting access of passengers to one of said vehicles located at one of said stations, said method comprising the steps of:

(1) detecting the presence of an object by actuation of said structural means, the presence of said object being defined as a fault condition;

(2) signaling said fault condition;

(3) stopping the track on which said one vehicle in said station is situated and stopping all other tracks in said station without stopping said cruising speed tracks; and (4) cancelling steps (2) and (3) after said fault condition has been removed to progressively return said system to normal operation.

2. A method according to claim 1, further comprising slowing said transition tracks after step (3).

3. A method according to claim 1, further comprising rerouting and parking said vehicles after step (3).

4. A method according to claim 2, further comprising stopping said cruising speed tracks after slowing the transition tracks.

5. A method according to claim 3, further comprising stopping said cruising speed tracks after rerouting and parking said vehicles.

6. An operating method according to claim 1 which comprises the further step of stopping and accumulating vehicles at one station in response to the detection of a fault condition at another station.

7. A method according to claim 1 or claim 6, wherein the tracks are slowed by selecting at least one of a set of predetermined speeds comprising null speed, a slow speed, a normal speed and an intermediate speed between the slow and normal speeds.

8. A method according to claim 7, wherein said slow speed is the same as the speed of the disembarkation track.

9. A method according to claim 7, wherein the slow speed is selected after the passage of a vehicle and the normal speed is selected after a predetermined time interval from the selection of the slow speed.

10. A method according to claim 1 or 6 wherein immediately upstream of a disembarkation track there is located an approach track running at a speed higher than the disembarkation speed, the difference between the two speeds being selected to minimize the effect of a collision between said two vehicles.

11. A method according to claim 1 or 6, wherein a transition track immediately upstream of a cruising speed track is run continuously at a speed substantially equal to that of the cruising speed track.

12. A semi-continuous passenger transport system for conveying passengers between at least two stations, comprising:

a plurality of driving tracks located between and in said stations;

non-motorized vehicles driven by said driving tracks along a circuit serving at least two of said stations have platforms for embarkation and disembarkation of passengers from said vehicles, each of said vehicles having at least one door for providing access to said vehicle through an opening therein;

safety wall members provided on said platforms, each of said safety wall members being movable and having a portion extending parallel to the path of travel of said vehicles along the associated platform, movement of any of said safety wall members stopping the vehicle immediately adjacent said safety wall member; and means for closing said door when the upstream edge of said door is in a position downstream from the upstream edge of the associated safety wall member, whereby said safety wall members effectively gradually close off access to said vehicles and prevent the passengers from interfering with the operation of said vehicle doors.

13. A transport system as claimed in claim 12 which further comprises means for closing said vehicle doors as said safety wall members close off access to said doorways.

14. A transport system according to claim 12, wherein each of said safety wall members comprises a pivoted control wall having a vertical surface parallel to the edge of said platform at the level of which said vehicle openings move as said vehicles pass, said safety wall being extended continuously on the upstream side by a surface defining the end of the platform and extending its edge to attachment means secured to said platform, said control wall being resiliently urged towards an unoperated position.

15. A system according to claim 14, wherein said control wall comprises two panels, an upstream panel acting as a detector for the signaling system and a downstream panel pivoted to the upstream panel acting as a passenger position monitoring means.

16. A system according to claim 14 or 15, for use with vehicles with sliding doors, wherein means are provided for closing said doors as they move past said control wall.

17. A system according to claim 14 or 15, for use with vehicles with doors, wherein, as the doors are closing, said control wall is momentarily inserted partially between said vehicle and said door.

18. A system according to claim 17, wherein each of said doors moves laterally over the opening in said vehicle, said doors remaining substantially vertical and parallel to the edge of said platform on arms which pivot about vertical axes, thereby forming at least one deformable parallelogram.

19. A system according to claim 16 wherein said means for closing said doors comprises:

a main shaft rotatably supported on said vehicle;

a wheel mounted on said main shaft;

a constant speed drive band secured to said platform for rotating said wheel;

a support track;

a support arm attached to said main shaft having a roller at one end thereof, said roller being maintained in contact with said support track; and a torque-limiting clutch for mounting said roller in contact with said support track with constant torque, the rotation of said main shaft closing said door as said vehicle moves past said control wall.

20. A system according to claim 17 wherein said means for closing said doors comprises:

a main shaft rotatably supported on said vehicle;

a wheel mounted on said main shaft;

a constant speed drive band secured to said platform for rotating said wheel;

a support track;

a support arm attached to said main shaft having a roller at one end thereof, said roller being maintained in contact with said support track; and a torque-limiting clutch for mounting said roller in contact with said support track with constant torque, the rotation of said main shaft closing said door as said vehicle moves past said control wall.

21. A system according to claim 19, wherein means for detecting an impediment to closure of said door are coupled to said support track.

22. A transport system according to claim 2, wherein each of said vehicles comprises two independent rotary units braked against rotation, one at least of which is in slip-free contact with one of said driving tracks while the vehicle is in a station, said one unit rotating if the vehicle speed is not the same as the speed of said track, such rotation exerting a force on the vehicle tending to modify its speed until equalized with the speed of said track.

* * * * *